US005472532A

United States Patent [19]

Wallace, II

[11] Patent Number: 5,472,532

[45] Date of Patent: Dec. 5, 1995

[54] AMBIENT TEMPERATURE MIX, CAST, AND CURE COMPOSITE PROPELLANT FORMULATIONS

[75] Inventor: Ingvar A. Wallace, II, Brigham City, Utah

[73] Assignee: Thiokol Corporation, Ogden, Utah

[21] Appl. No.: 76,410

[22] Filed: Jun. 14, 1993

[51] Int. Cl.[6] ..... C06B 45/10

[52] U.S. Cl. ..... 149/17.4; 149/19.9

[58] Field of Search ..... 149/19.4, 19.9

[56] References Cited

U.S. PATENT DOCUMENTS

| | | | |
|---|---|---|---|
| 3,790,416 | 2/1974 | Dehm | 149/19 |
| 3,891,709 | 6/1975 | Higuchi et al. | 260/584 B |
| 4,491,538 | 1/1985 | McCoy | 252/541 |
| 4,708,754 | 11/1987 | Sayles | 149/19.4 |
| 4,789,691 | 12/1988 | Matzke et al. | 521/159 |
| 4,799,980 | 1/1989 | Reed, Jr. | 149/19.4 |
| 4,913,753 | 4/1990 | Ducote | 149/19.9 |
| 4,915,755 | 4/1990 | Kim | 149/19.4 |
| 4,971,640 | 11/1990 | Chi | 149/19.9 |
| 5,334,270 | 8/1994 | Taylor, Jr. | 149/19.4 |
| 5,336,343 | 8/1994 | Hamilton et al. | 149/19.9 |
| 5,348,596 | 9/1994 | Goleniewski et al. | 149/19.4 |
| 5,417,895 | 5/1995 | Oberth | 149/19.4 |

OTHER PUBLICATIONS

Ducote M. "Amine Salts AS AP Bonding Agents".

*Primary Examiner*—Edward A. Miller

*Attorney, Agent, or Firm*—Ronald L. Lyons; Madson & Metcalf

[57] ABSTRACT

Composite propellant formulations containing a novel combination of bonding agent and cure catalyst together with carefully balanced HTPB binder and isocyanate curative may be mixed, cast, and cured at ambient temperature. The NCO/OH ratio is in the range from about 0.8 to about 0.9. The propellant formulations include as typical solid ingredients an oxidizer such as ammonium perchlorate and a reactive metal fuel such as aluminum. A plasticizer may optionally be included in the propellant to improve processing and low temperature properties. The bonding agents used in the present invention include a Schiff base or a combination of Schiff base and hydroxyl or amine functionality.

19 Claims, No Drawings

AMBIENT TEMPERATURE MIX, CAST, AND CURE COMPOSITE PROPELLANT FORMULATIONS

BACKGROUND OF THE INVENTION

1. Field of the Invention

This invention relates to solid rocket propellant formulations. More specifically, the present invention relates composite propellant formulations which may be mixed, cast, and cured at ambient temperature.

2. Technology Background

Solid propellants are used extensively in the aerospace industry and are a preferred method of powering most missiles and rockets for military, commercial, and space applications. Solid rocket motor propellants have become widely accepted because they are relatively simple to manufacture and use, and because they have excellent performance characteristics.

Typical solid rocket motor propellants are formulated using an oxidizing agent, a fuel, and a binder. At times, the binder and the fuel may be the same. In addition to the basic components, it is conventional to add various bonding agents, plasticizers, curing agents, cure catalysts, and other similar materials which aid in the processing or curing of the propellant or contribute to mechanical properties of the cured propellant. A significant body of technology has developed regarding the processing and curing of solid propellants.

Many types of propellants used in the industry incorporate ammonium perchlorate (AP) as the oxidizer. The AP is generally incorporated into the propellant in particulate form. In order to hold the propellant in a coherent form, the components of the propellant are bound together by a polymeric binder, such as, but not limited to, a hydroxy-terminated polybutadiene (HTPB) binder. Such binders are widely used and commercially available. It has been found that such propellant compositions are easy to manufacture and handle, have good performance characteristics, and are economical and reliable. As a result, this type of solid propellant has become a standard in the industry.

Propellants must generally meet various mechanical and chemical performance criteria to be considered acceptable for routine use. For example, it is important that the propellant have desired mechanical characteristics which allow it to be used in a corresponding rocket or missile. It is important that the propellant deform elastically during use to avoid cracking within the propellant grain.

If the propellant cracks, burning within the crack may be experienced during operation of the rocket or missile. Such burning in a confined area may result in an increased surface area of burning propellant or increased burn rate at a particular location. This increase in the burn rate and surface area can directly result in failure of the rocket motor due to over pressurization or burn through of the casing.

Accordingly, propellants are typically subjected to standardized stress and strain tests. The typical configuration of the propellant sample tested is often referred to as a JANNAF Class C specimen. The shape and size of such specimens are standard in the industry. Such specimens are typically placed in an Instron® testing apparatus and then pulled until the specimen fails. Data is recorded during such tests and objective measures of stress and strain performance are provided.

To make certain that propellant formulations meet the applicable specifications, it is often necessary to employ a bonding agent within the propellant composition. Bonding agents are widely used throughout the solid propellant industry to strengthen the polymeric matrix which binds the oxidizer and fuel together. They help to incorporate solid oxidizer particles into the polymeric binder system. Use of a bonding agent typically improves the stress and strain characteristics of the propellant.

A number of bonding agents are known and conventional. One class of bonding agents are the polyamine bonding agents TEPANOL® (tetraethylenepentamine acrylonitrile glycidol adduct) and TEPAN® (partially cyanoacrylated tetraethylenepentamine). TEPANOL® and TEPAN® are useful as bonding agents and improve the mechanical properties of isocyanate cured HTPB propellants. TEPANOL® and TEPAN® are believed to become chemically linked to the polymeric propellant binder. TEPANOL® and TEPAN® also electrostatically coordinate with the AP after forming a perchlorate salt from an acid/base reaction with AP. Thus, TEPANOL® and TEPAN® aid in binding the AP particles into the propellant matrix.

TEPANOL® and TEPAN®, however, also cause difficulty in the formulation of propellant. TEPANOL® and TEPAN® are relatively basic, and in the presence of AP they produce a significant amount of ammonia. This makes it necessary to conduct propellant mixing steps under vacuum and to mix for long periods of time in order to substantially remove the produced ammonia. It often requires 24 hours or more to adequately remove the ammonia from TEPANOL® and TEPAN® systems. This significantly extends propellant processing time and increases costs. Insufficient removal of the ammonia can result in soft cures and nonreproducible mechanical properties because the free ammonia reacts with some of the isocyanate curing agent. These characteristics of TEPANOL® and TEPAN® result in significant disadvantages, such as long mix time, high labor costs, and AP attrition.

In another important class of bonding agents, the aziridines (i.e., cyclic ethylene imines), it is believed that a polymeric shell is formed directly around the oxidizer particles by homopolymerization, catalyzed by acidic AP. This hydrophobic layer is then more compatible with the continuous binder phase and results in better bonding of the AP particles. Since this reaction does not occur on nitramine surfaces, aziridines are limited to AP propellants.

Isophthaloyl-bis(methyl-ethyleneimide), known as HX-752 in the industry, is a widely used aziridine bonding agent. HX-752 has the following chemical structure:

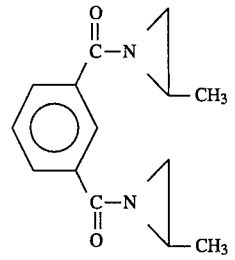

HX-752 is believed to be incorporated into the propellant matrix by ring opening polymerization. HX-752 avoids the production of large amounts of ammonia which plague processes using TEPANOL® and TEPAN®. As a result, some advantages are derived from the use of HX-752.

Even in view of the foregoing, HX-752 is far from ideal as a bonding agent. One significant problem is that of economics. HX-752 presently costs from four to five times as much as TEPANOL®. Also, propellants produced using HX-752 have a relatively high mix viscosity, which inhibits processing. HX-752, as used in the industry, does produce some ammonia which may require extra vacuum mixing. Finally, it is also believed that HX-752 may be a carcinogen. Thus, it can be seen that the cost and chemical characteristics of HX-752 make it a less than ideal bonding agent.

Another disadvantage of TEPANOL®, TEPAN®, HX-752 and other known bonding agents is that they require processing and curing at elevated temperatures, about 135° F. The elevated curing temperature speeds the curing process. At ambient temperatures, about 80° F., cure times are often six to eight weeks, which is unacceptably long. While cure catalysts can be used to shorten cure times, doing so often results in inadequate potlife and inferior mechanical properties when compared to the same propellant processed and cured at higher temperature. Lower end-of-mix (EOM) viscosity and longer potlife may be obtained by increasing the level of plasticizer in the formulation (at the expense of mechanical properties), or finding replacements for ingredients which are detrimental to processing.

Accordingly, it would be an advancement in that art to provide composite propellant formulations containing bonding agents which may be mixed, processed, and cured at ambient temperature without raising propellant viscosities and without producing significant quantities of ammonia. Such propellant formulations would contribute to lower power requirements, shorter mixing times, lower labor costs, faster mixer turnaround times, and less AP attrition. It would also be an advancement in the art to provide such ambient processed and cured propellants having acceptable stress and strain characteristics.

Such composite propellant formulations are disclosed and claimed herein.

SUMMARY OF THE INVENTION

The invention is directed to composite propellant formulations containing a novel combination of bonding agent and cure catalyst together with carefully balanced HTPB binder and isocyanate curative, which enables the propellant to be mixed, cast, and cured at ambient temperature. The propellant formulations within the scope of the present invention include, as typical solid ingredients, an oxidizer such as ammonium perchlorate and a reactive metal fuel such as aluminum. A plasticizer such as DOA (dioctyladipate) may optionally be included in the propellant to improve processing.

The bonding agents used in the present invention include a Schiff base or a combination of Schiff base and hydroxyl or amine functionality. The cure catalysts used in the present invention are selected to match the isocyanate curative. One currently preferred cure catalyst is triphenyltin chloride (TPTC). Other possible cure catalysts which may be used in the present invention include dibutyltin dilaurate (DBTDL), iron acetylacetonate ($Fe(AA)_3$), and triphenylbismuth (TPB).

Schiff bases are a class of imines. An imine is generally defined as the reaction product of an amine or ammonia and carbonyl group of either an aldehyde or ketone. This reaction results in a molecule with at least one C=N group. In that context, it has been discovered that unsubstituted imines formed from ammonia are generally unstable and polymerize on standing. However, if a primary amine is used instead of ammonia, a more stable reaction product, a substituted imine, is formed. This product is known in the art as a Schiff base. Therefore, a Schiff base is an imine (having at least one C=N group) formed by the reaction of a primary amine with an aldehyde or ketone, and preferably in which at least one of the functional residues is aromatic.

It is generally found that aromatic aldehydes or arylamines result in the most stable imines. Other aldehydes or ketones may also be used, and Schiff bases formed from such aldehydes or ketones are to be considered to fall within the scope of the present invention.

The primary amine used to prepare the bonding agents for use in the present invention may be virtually any amine or —OH containing amine. The amine may be of substantially any carbon chain length and may be branched or unbranched. Other functional groups may also be included on the primary amine molecule, so long as those groups do not interfere with the necessary reaction. Such groups may include ethers and esters.

In order to provide the desired hydroxyl functionality, the primary amine may also be reacted with an epoxide, acrylonitrile, acrylate, methacrylate, or similar molecule capable of imparting hydroxyl functionality to the end product. One such epoxide which provides goods results is glycidol; however, a variety of epoxides are capable of providing the same function. Glycidol has the following structure:

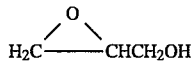

A general description of one preferred group of bonding agents within the scope of the present invention would include the following general structure:

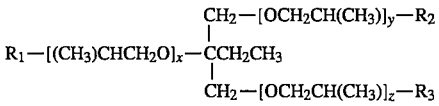

Where $R_2$, $R_2$, are $R_3$ may be the same or different selected from

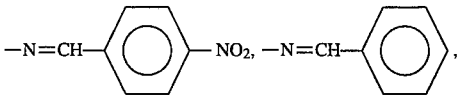

—OH, $—NHCH_2CH(OH)CH_2OH$, $—NHCH_2CH_2OH$, $—NH_2$, or $—NHCH_2CH_2CN$, and where the sum x+y+z is in the range from about 3 to about 20, preferably from about 4 to about 8, and most preferably about 5.3. The bonding agents are prepared by reacting a polyoxypropylenetriamine (available from Texaco, Co. under the name Jeffamine®), with p-nitrobenzaldehyde, benzaldehyde, glycidol, or mixtures thereof. Depending on the reactants, the product formed from the reaction contains varying amounts of imine and hydroxyl functionality.

The compounds produced in this manner have been found to constitute effective bonding agents in the formulation of propellant compositions, particularly ammonium perchlorate-based propellants. When these bonding agents are used in the propellant formulations of the present invention, propellant cracking and undesired burning is avoided. At the same time the propellants are found to have suitable stress and strain characteristics and the propellants do not produce excessive quantities of ammonia during mixing.

The bonding agents used herein are believed to result in polar coordination with ammonium perchlorate within the propellant. The N=C group provides a dipole which is sufficient to result in an association with the ammonium perchlorate. At the same time, the existence of isocyanate reactive functional groups (hydroxyl or amine) provides the mechanism for incorporating the bonding agent within the propellant (polymer) matrix.

Accordingly, typical propellants within the scope of the present invention comprise from about 10% to about 20% hydroxy-terminated polybutadiene (HTPB) binder, from about 0.1% to about 0.2% of the Schiff base bonding agents disclosed herein, from about 0.7% to about 1.6% isocyanate curative, from about 50% to about 90% oxidizer (which may be in multiple particle sizes), and from about 0.003% to about 0.01% cure catalyst. All percentages are by weight. Other materials may also be included such as fuels (including reactive metals) and plasticizers. The isocyanate to hydroxyl ratio (NCO/OH) is preferably in the range from about 0.8 to about 0.9, and more preferably from about 0.85 to about 0.9.

Importantly, the propellant formulations of the present invention containing the bonding agents described herein have end-of-mix viscosities 3 to 8 kP (kilo poise) lower than analogous HX-752 containing formulations. The inherently lower EOM viscosity of the present propellant formulations permit higher catalyst levels to be used resulting in a faster cure time (time to constant Shore A hardness) while maintaining a 6-hour potlife.

DETAILED DESCRIPTION OF THE INVENTION

The present invention is directed to composite propellant formulations which may be mixed, cast, and cured at ambient temperature. The propellant formulations contain a novel combination of polymeric HTPB (hydroxy-terminated polybutadiene) binder, isocyanate curative such as isophorone diisocyanate (IPDI), dimer diisocyanate (DDI), or tetramethylxylenediisocyanate (TMXDI), bonding agent such as those described herein, and cure catalyst selected to match the isocyanate curative such as triphenyltin chloride (TPTC). Together, these binder ingredients enable ambient temperature composite propellant processing and curing. The propellant formulations within the scope of the present invention also generally include an oxidizer such as ammonium perchlorate and a reactive metal fuel such as aluminum. A plasticizer, such as DOA (dioctyladipate) is optionally included.

The bonding agents used in the present invention include a Schiff base or a combination of Schiff base and hydroxyl or amine functionality. The preferred bonding agents used in the present invention are prepared by reacting a polyoxypropylenetriamine (available from Texaco, Co. under the name Jeffamine®), with p-nitrobenzaldehyde, benzaldehyde, glycidol, or mixtures thereof. Depending on the reactants, the product formed from the reaction contains varying amounts of imine and hydroxyl functionality. Because Jeffamine® is a trifunctional molecule, one mole of Jeffamine® will react with three moles of aromatic aldehyde, ketone, or other reactive group.

The reaction may be run in toluene or another solvent that will allow the reaction to proceed. A water by-product is produced during the bonding agent synthesis, and water may be removed from the reaction mixture by known techniques. For example, azeotropic distillation or drying agents, such has calcium chloride, have been found to be suitable for water removal.

The reaction product is not necessarily uniform, but this fact does not detract from the usefulness of the product. For example, the reacted mixture may include a small percentage of unreacted Jeffamine® molecules along with mono-, di-, and tri-imine (Schiff base) reaction products. In addition, the reacted mixture may include mono, di-, and tri-dihydroxypropyl products, when glycidol is a reactant.

These Schiff base polyether-hydroxy-imine compounds when used with an HTPB and isocyanate curative such that the NCO/OH ratio is in the range from about 0.8 to about 0.9, and with a cure catalyst, permit propellant mixing, casting, and curing at ambient temperature.

It is presently believed that the Schiff base imine attracts and aligns with ammonium perchlorate in the propellant formulation by means of a partial electrostatic interaction. This is accomplished by the nature of the Schiff base, i.e. the C=N group has partial charges ($\delta^+$–$\delta^-$) which are sufficient to align with the polar ammonium perchlorate molecule. In addition, the conversion of the amine to an imine, along with low temperature processing, substantially eliminates the problem of ammonia production in the formulation of propellants.

The Schiff base bonding agents described herein may also include hydroxyl or amine functionality. These functional groups provide a mechanism for incorporation of the bonding agent and solid ammonium perchlorate within the binder matrix. The hydroxyl functionality reacts with the conventional isocyanate curative used in such propellant formulations. Thus, it is possible to incorporate large quantities of solid into the binder, while still maintaining favorable mechanical properties.

One currently preferred bonding agent for use in the present invention is prepared by the reaction of one mole polyoxypropylenetriamine (available from Texaco, Co. under the name Jeffamine®), with three moles benzaldehyde. The product formed from the reaction contains primarily imine functionality. The reaction is essentially as follows:

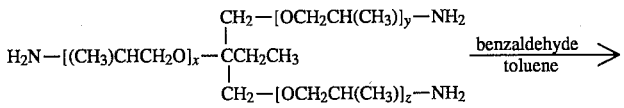

-continued

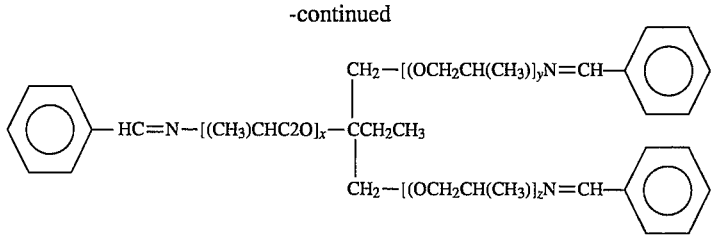

Where the sum x+y+z is from about 3 to about 20.

Another currently preferred bonding agent for use in the present invention is prepared by the reaction of one mole polyoxypropylenetriamine, with two moles benzaldehyde and one mole glycidol. The product formed from the reaction contains varying amounts of imine and hydroxyl functionality. The reaction is essentially as follows:

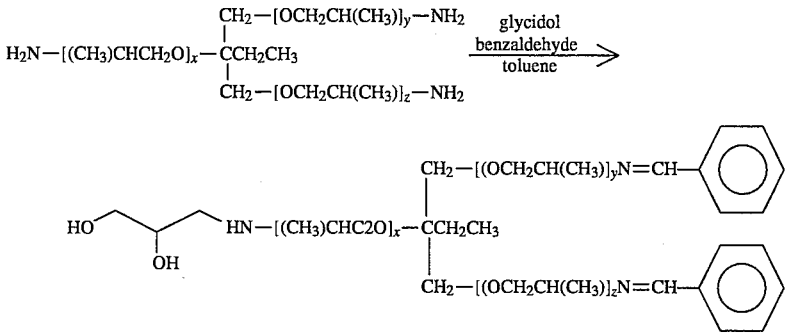

Where the sum x+y+z is from about 3 to about 20.

Another preferred bonding agent for use in the present invention is prepared by the reaction of one mole polyoxypropylenetriamine, with two moles p-nitrobenzaldehyde and one mole glycidol. The product formed from the reaction contains varying amounts of imine and hydroxyl functionality. The reaction is essentially as follows:

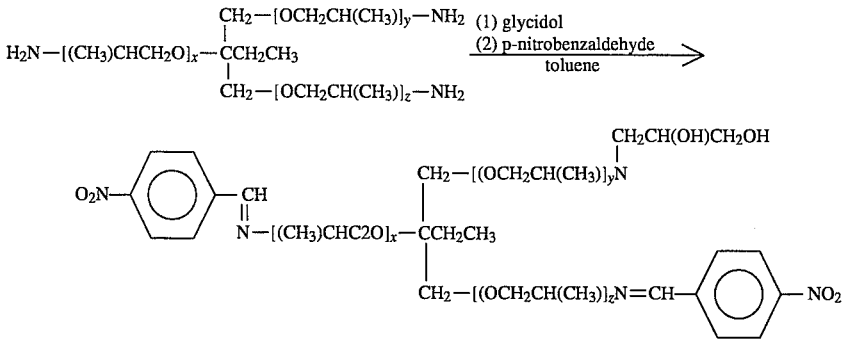

Where the sum x+y+z is from about 3 to about 20.

Typical propellants within the scope of the present invention comprise from about 10% to about 20% polymeric binder. The binder will preferably be a hydroxy-terminated polybutadiene (HTPB), such as R-45M manufactured by ATOCHEM, having about 2.3 functional groups per molecule. In addition, the propellant formulations preferably include from about 0.7% to about 1.6% of an isocyanate curative, such as isophorone diisocyanate (IPDI), dimer diisocyanate (DDI), or tetramethylxylenediisocyanate (TMXDI), which cross-links the HTPB polymer. The isocyanate to hydroxyl ratio (NCO/OH) is preferably in the range from about 0.8 to about 0.9, and more preferably from about 0.85 to about 0.9, with a ratio of about 0.86 being most preferred.

A cure catalyst, such as triphenyltin chloride, dibutyltin dilaurate, iron acetylacetonate, and triphenylbismuth are preferably added in the range from about 0.003% to about 0.01%. The Schiff base bonding agents described herein are added to the propellant formulation in a range from about 0.1% to about 0.2% concentration by weight. Since bonding agents are nonenergetic propellant ingredients, the amount of bonding agents added to the propellant should be minimized. Plasticizers, such as DOA (dioctyladipate), IDP (isodecylperlargonate), DOP (dioctylphthalate), DOM (dioctylmaleate), or DBP (dibutylphthalate), processing aids, and other similar types of additives are often included in the propellant formulation to improve processing. All percentages used herein are by weight.

Added to the polymeric binder is from about 50% to about 90% oxidizer. The oxidizer generally takes the form of solid particulate ammonium perchlorate having varying particle sizes. Typical particle sizes include 400μ, 200μ, and 20μ particles. It is conventional in propellant formulations to combine ammonium perchlorate particles of multiple sizes. Fuels (including reactive metals such as aluminum, magnesium, aluminum-magnesium alloys, boron, etc.) are commonly included in propellant formulations to improve performance.

Importantly, the propellant formulations containing the bonding agents described herein have lower end-of-mix viscosities than corresponding HX-752 propellants. Thus, greater amounts of cure catalyst may be used in the propellant formulations of the present invention, which provide shorter cure times.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

A bonding agent having the following structure (herein after referred to as "BASH 68"), was synthesized:

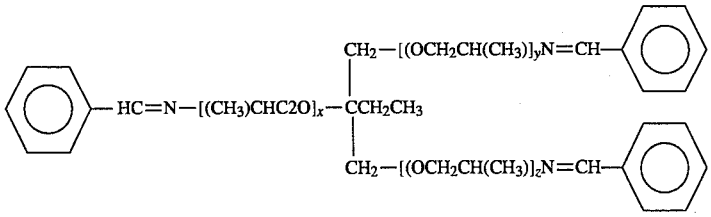

Where x+y+z=5.3. BASH 68 was prepared by reacting the following reagents:

| Material | Grams | Moles/Equiv. |
|---|---|---|
| Jeffamine ® T-403 | 30.00 | 0.1936 eq. |
| benzaldehyde | 20.56 | 0.1937 |

The synthesis occurred in a 300 ml three-neck round bottom flask equipped with a dean-stark trap, condenser, heating mantle, and thermometer. The synthesis was initiated by placing 30 grams of Jeffamine® in the flask along with 20.56 grams of benzaldehyde in 200 ml. of toluene. The mixture was heated to reflux for two hours or until 2 ml. of water was recovered from the trap. The reaction product was then recovered and dried with sodium sulfate. The sodium sulfate was filtered off, and the toluene was removed by vacuum.

Example 2

BASH 68 bonding agent, prepared according to Example 1, was used at 0.15 percent concentration by weight in an 88 percent solids propellant formulation which was mix, cast, and cured at ambient temperature. The propellant had the following ingredients:

| Ingredient | Weight % |
|---|---|
| HTPB R-45M | 10.12 |
| BASH 68 | 0.15 |
| Al (35μ) | 19.00 |
| AP (200μ) | 55.20 |
| AP (20μ) | 13.80 |
| DOA plasticizer | 1.00 |
| IPDI curative | 0.72 |
| TPTC catalyst | 0.01 |

The NCO/OH ratio was 0.82. The propellant processed well, having an end-of-mix (EOM) viscosity of about 15 kP and an EOM temperature of 82° F. The potlife (time from curative addition until the viscosity reaches 40 kP) was 6 hours. The propellant had the following mechanical properties:

| Mechanical Properties (Average) | |
|---|---|
| Days From EOM | 39 |
| $E_t^{2.6}$ (psi) | 403 |
| $\epsilon_{m_{t,c}}$ (%) | 67 |
| $\epsilon_{m_t}$ (%) | 74 |
| $\epsilon_f$ (%) | 77 |
| $\sigma_{m_c}$ (psi) | 110 |
| $\sigma_m$ (psi) | 188 |

-continued

| Mechanical Properties (Average) | |
|---|---|
| Shore A | 58 |
| Cure time (days) | 15 |
| Number Specimens | 2 |

Example 3

BASH 68 bonding agent, prepared according to Example 1, was used at 0.15 percent concentration by weight in an 88 percent solids propellant formulation which was mix, cast, and cured at ambient temperature. The propellant had the following ingredients:

| Ingredient | Weight % |
|---|---|
| HTPB R-45M | 10.10 |
| BASH 68 | 0.15 |
| Al (35μ) | 19.00 |
| AP (200μ) | 55.20 |

-continued

| Ingredient | Weight % |
|---|---|
| AP (20μ) | 13.80 |
| DOA plasticizer | 1.00 |
| IPDI curative | 0.74 |
| TPTC catalyst | 0.01 |

The NCO/OH ratio was 0.84. The propellant processed well, having an end-of-mix (EOM) viscosity of about 15 kP and an EOM temperature of 81° F. The potlife was >6 hours. The propellant had the following mechanical properties:

| Mechanical Properties (Average) | |
|---|---|
| Days Form EOM | 39 |
| $E_t^{2.6}$ (psi) | 497 |
| $\epsilon_{m_{t,c}}$ (%) | 63 |
| $\epsilon_{m_t}$ (%) | 72 |
| $\epsilon_f$ (%) | 75 |
| $\sigma_{m_c}$ (psi) | 120 |
| $\sigma_m$ (psi) | 194 |
| Shore A | 60 |
| Cure time (days) | 15 |
| Number Specimens | 3 |

Example 4

BASH 68 bonding agent, prepared according to Example 1, was used at 0.15 percent concentration by weight in an 88 percent solids propellant formulation which was mix, cast, and cured at ambient temperature. The propellant had the following ingredients:

| Ingredient | Weight % |
|---|---|
| HTPB R-45M | 10.08 |
| BASH 68 | 0.15 |
| Al (35μ) | 19.00 |
| AP (200μ) | 55.20 |
| AP (20μ) | 13.80 |
| DOA plasticizer | 1.00 |
| IPDI curative | 0.76 |
| TPTC catalyst | 0.01 |

The NCO/OH ratio was 0.86. The propellant processed well, having an end-of-mix (EOM) viscosity of about 14 kP and an EOM temperature of 81° F. The potlife was >5 hours. The propellant had the following mechanical properties:

| Mechanical Properties (Average) | |
|---|---|
| Days From EOM | 39 |
| $E_t^{2.6}$ (psi) | 676 |
| $\epsilon_{m_{t,c}}$ (%) | 48 |
| $\epsilon_{m_t}$ (%) | 55 |
| $\epsilon_f$ (%) | 58 |
| $\sigma_{m_c}$ (psi) | 139 |
| $\sigma_m$ (psi) | 210 |
| Shore A | 68 |
| Cure time (days) | 10 |
| Number Specimens | 3 |

Example 5

HX-752 bonding agent was used at 0.30 percent concentration by weight in three 88 percent solids propellant formulations which were mix, cast, and cured at ambient temperature. The propellant formulations had the following ingredients:

| Ingredient | Mix A Weight % | Mix B Weight % | Mix C Weight % |
|---|---|---|---|
| HTPB R-45M | 10.02 | 10.017 | 10.015 |
| HX-752 | 0.30 | 0.30 | 0.30 |
| Al (35μ) | 19.00 | 19.00 | 19.00 |
| AP (200μ) | 55.20 | 55.20 | 55.20 |
| AP (20μ) | 13.80 | 13.80 | 13.80 |
| DOA plasticizer | 1.00 | 1.00 | 1.00 |
| IPDI curative | 0.68 | 0.68 | 0.68 |
| TPTC catalyst | 0.00 | 0.003 | 0.005 |

The NCO/OH ratio was 0.78 in all mixes. The following mechanical properties were observed in the propellant formulations:

| Mechanical Properties (Average) | | | |
|---|---|---|---|
| | Mix A | Mix B | Mix C |
| EOM Visc. (kP) | 16 | 18 | 22 |
| EOM Temp. (°F.) | 88 | 89 | 82 |
| Potlife (hours) | 30 | 6 | 6 |
| Days From EOM | 42 | 31 | 54 |
| $E_t^{2.6}$ (psi) | 611 | 590 | 508 |
| $\epsilon_{m_{t,c}}$ (%) | 55 | 48 | 57 |
| $\epsilon_{m_t}$ (%) | 57 | 57 | 60 |
| $\epsilon_f$ (%) | 59 | 59 | 62 |
| $\sigma_{m_c}$ (psi) | 140 | 109 | 107 |
| $\sigma_m$ (psi) | 218 | 167 | 170 |
| Shore A | 65 | 60 | 60 |
| Cure time (days) | 32 | 17 | 27 |
| Number Specimens | 2 | 4 | 4 |

From the results of Examples 2–5, it will be appreciated that the BASH 68 propellant formulations tolerate higher cure catalyst levels compared to the HX-752 formulations, which result in a dramatically shortened cure time while maintaining a potlife of six hours. Mechanical properties (2 ipm, 75° F.) of the BASH 68 formulations are excellent, being nearly indistinguishable from HX-752 formulations which are processed and cured at 135° F. Importantly, no ammonia was detected during the processing method of the present invention, which might otherwise extend the propellant mixing time.

From the foregoing it will be appreciated that the present invention provides composite propellant formulations containing bonding agents which may be mixed, processed, and cured at ambient temperature without raising propellant viscosities and without producing significant quantities of ammonia. Such propellant formulations contribute to lower power requirements, shorter mixing times, lower labor costs, faster mixer turnaround times, and less AP attrition. The present invention also provides ambient cured propellants having acceptable stress and strain characteristics. An additional important benefit of processing and curing propellants at ambient temperature is the elimination of temperature induced strain caused by thermal loading upon post-cure cool-down.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A solid propellant formulation capable of being mixed, cast, and cured at ambient temperature comprising:

hydroxy-terminated polybutadiene binder present in an amount ranging from about 8% to about 20% by weight;

an isocyanate curative present in an amount ranging from about 0.7% to about 1.6% by weight, such that the NCO/OH ratio is in the range from about 0.8 to about 0.9;

a cure catalyst;

an oxidizer present in an amount ranging from about 50% to about 90% by weight;

a fuel present in an amount ranging from about 0% to about 20% by weight; and a bonding agent present in an amount ranging from about 0.1% to about 0.2% by weight, said bonding agent having the following general formula:

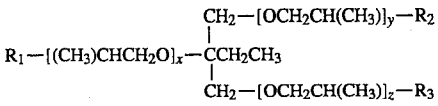

Where $R_1$, $R_2$, are $R_3$ may be the same or different selected from

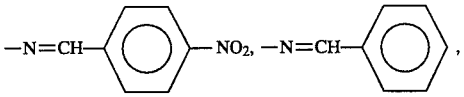

—OH, —$NHCH_2CH(OH)CH_2OH$, —$NHCH_2CH_2OH$, —$NH_2$, or —$NHCH_2CH_2CN$; and where the sum x+y+z is from about 3 to about 20.

2. A solid propellant composition as defined in claim 1, wherein $R_1$, $R_2$, and $R_3$ comprise

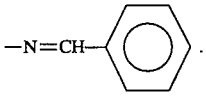

3. A solid propellant composition as defined in claim 1, wherein the fuel includes aluminum particles.

4. A solid propellant composition as defined in claim 1, wherein the fuel includes aluminum-magnesium alloy particles.

5. A solid propellant composition as defined in claim 1, wherein the fuel includes magnesium particles.

6. A solid propellant composition as defined in claim 1, wherein the oxidizer is ammonium perchlorate.

7. A solid propellant composition as defined in claim 6, wherein the ammonium perchlorate is present in a bimodal size distribution.

8. A solid propellant composition as defined in claim 1, wherein the curative is isophorone diisocyanate (IPDI).

9. A solid propellant composition as defined in claim 1, wherein the curative is tetramethylxylenediisocyanate (TMXDI).

10. A solid propellant composition as defined in claim 1, wherein the curative is dimer diisocyanate (DDI).

11. A solid propellant composition as defined in claim 1, wherein the cure catalyst is triphenyltin chloride (TPTC).

12. A solid propellant composition as defined in claim 1, further comprising a plasticizer.

13. A solid propellant composition as defined in claim 1, wherein the sum x+y+z is from about 4 to about 8.

14. A solid propellant formulation capable of being mixed, cast, and cured at ambient temperature comprising:

hydroxy-terminated polybutadiene binder present in an amount ranging from about 8% to about 12% by weight;

an isocyanate curative present in an amount ranging from about 0.7% to about 0.8% by weight, such that the NCO/OH ratio is in the range from about 0.8 to about 0.9;

a cure catalyst;

a plasticizer;

ammonium perchlorate present in an amount ranging from about 60% to about 75% by weight;

a fuel present in an amount ranging from about 10% to about 20% by weight; and a bonding agent present in an amount ranging from about 0.1% to about 0.2% by weight, said bonding agent having the following general formula:

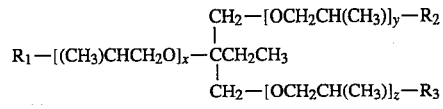

Where $R_1$, $R_2$, are $R_3$ may be the same or different selected from

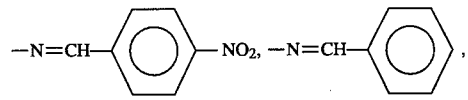

—OH, —$NHCH_2CH(OH)CH_2OH$, —$NHCH_2CH_2OH$, —$NH_2$, or —$NHCH_2CH_2CN$; and where the sum x+y+z is from about 3 to about 20.

15. A solid propellant composition as defined in claim 14, wherein the fuel includes aluminum particles.

16. A solid propellant composition as defined in claim 15,wherein $R_1$, $R_2$, and $R_3$ comprise

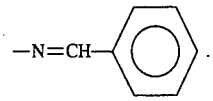

17. A solid propellant composition as defined in claim 16, wherein the sum x+y+z is from about 4 to about 8.

18. A solid propellant composition as defined in claim 17, wherein the isocyanate curative is isophorone diisocyanate (IPDI).

19. A solid propellant formulation capable of being mixed, cast, and cured at ambient temperature comprising:

hydroxy-terminated polybutadiene binder present in an amount ranging from about 8% to about 12% by weight;

isophorone diisocyanate curative present in an amount ranging from about 0.7% to about 0.8% by weight, such that the NCO/OH ratio is in the range from about 0.85 to about 0.9;

triphenyltin chloride cure catalyst;

dioctyladipate plasticizer;

ammonium perchlorate oxidizer present in an amount ranging from about 65% to about 70% by weight, wherein said ammonium perchlorate is present in a bimodal size distribution;
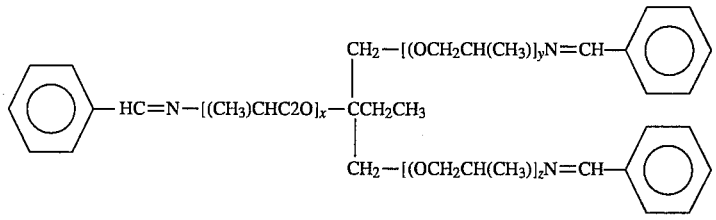
aluminum fuel present in an amount ranging from about 15% to about 20% by weight; and
a bonding agent present in an amount ranging from about 0.1% to about 3% by weight, said bonding agent having the following formula:
where the sum x+y+z is from about 4 to about 8.
* * * * *